US007293693B2

(12) United States Patent
Gosis et al.

(10) Patent No.: US 7,293,693 B2
(45) Date of Patent: Nov. 13, 2007

(54) SINGLE PIECE PACKAGING CONTAINER AND DEVICE FOR MAKING SAME

(75) Inventors: Anatoly Gosis, Palatine, IL (US); Michael D. Loeschen, Hawthorne Woods, IL (US); Ian Brooks, Lake Barrington, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 11/551,468

(22) Filed: Oct. 20, 2006

(65) Prior Publication Data

US 2007/0039847 A1 Feb. 22, 2007

Related U.S. Application Data

(62) Division of application No. 10/644,130, filed on Aug. 20, 2003, now Pat. No. 7,140,533.

(51) Int. Cl.
*B65D 1/40* (2006.01)
*B65D 1/28* (2006.01)
*B65D 85/20* (2006.01)

(52) U.S. Cl. ..... 229/120.04; 206/443; 206/446; 220/DIG. 25; 229/127; 229/143

(58) Field of Classification Search ..... 229/120.04, 229/127
See application file for complete search history.

(56) References Cited

U.S. PATENT DOCUMENTS 973,927 A * 10/1910 Eddy ..... 229/120.04
1,035,634 A 8/1912 Platt
1,069,021 A 7/1913 Miller
1,102,820 A 7/1914 Thompson (Continued)

FOREIGN PATENT DOCUMENTS

EP 1405793 11/1978

(Continued)

OTHER PUBLICATIONS

EP Search Report dated Oct. 1, 2005 for EP Application No. 04254739.8.

*Primary Examiner*—Gary E Elkins
(74) *Attorney, Agent, or Firm*—Mark W. Croll; Donald J. Breh; Levenfeld Pearlstein, LLC

(57) ABSTRACT

Configurations for a packing container formed from a single, preformed, rigid unit of generally U-shaped cross-section are disclosed. One configuration utilizes three end closures to enclose an object with an elevated end. Another configuration employs three end closures to enclose an object with an elevated mid-section. A third configuration uses two end closures to enclose an object with random elevations. With three end closures, a fourth configuration encloses two or more dissimilar objects in separate compartments. The fourth configuration is especially useful for items that should be prevented from touching or intermingling during shipping. A fifth configuration combines elements of the other four configurations, allowing a user to ship objects with elevated ends, elevated mid-sections, or random elevations in separate compartments. A sixth configuration encloses one or more objects with two end closures that are about equal in length to one another. A device for forming the container is also disclosed.

1 Claim, 11 Drawing Sheets

U.S. PATENT DOCUMENTS

| | | | | | |
|---|---|---|---|---|---|
| 1,352,863 | A | | 9/1920 | Zietler et al. | |
| 1,758,230 | A | | 5/1930 | Lange | |
| 1,791,003 | A | | 2/1931 | Shearer | |
| 1,819,933 | A | | 8/1931 | Watson | |
| 1,871,888 | A | | 8/1932 | Johnson | |
| 1,880,191 | A | | 10/1932 | Bigelow | |
| 1,976,209 | A | | 10/1934 | Ashe | |
| 2,077,694 | A | | 4/1937 | Winton | |
| 2,122,654 | A | * | 7/1938 | Nickerson | 229/127 |
| 2,122,904 | A | | 7/1938 | Ambrosius | |
| 2,194,669 | A | | 3/1940 | Mumford | |
| 2,317,884 | A | | 4/1943 | Clouston | |
| 2,418,248 | A | | 4/1947 | Denton | |
| 2,718,980 | A | | 9/1955 | Strom | |
| 2,731,167 | A | | 1/1956 | Moore | |
| 2,778,559 | A | | 1/1957 | Boitel | |
| 3,111,254 | A | * | 11/1963 | Thyen | 229/127 |
| 3,332,601 | A | | 7/1967 | Frank, Jr. | |
| 3,392,904 | A | | 7/1968 | Wei | |
| 3,472,571 | A | | 10/1969 | Himeireich | |
| 3,543,994 | A | | 12/1970 | Clark | |
| 3,552,633 | A | | 1/1971 | Ketler | |
| 3,669,338 | A | | 6/1972 | Cornell et al. | |
| 3,744,659 | A | | 7/1973 | Koehler | |
| 3,833,116 | A | | 9/1974 | Howe | |
| 3,938,691 | A | | 2/1976 | Dumas | |
| 4,067,442 | A | | 1/1978 | Howe | |
| 4,126,222 | A | | 11/1978 | Aust | |
| 4,513,864 | A | | 4/1985 | Libel | |
| 4,607,750 | A | | 8/1986 | Valenti | |
| 4,629,069 | A | | 12/1986 | Pugh | |
| 4,662,512 | A | | 5/1987 | Durand | |
| 4,871,067 | A | | 10/1989 | Macaluso | |
| 4,976,374 | A | | 12/1990 | Macaluso | |
| 5,141,149 | A | | 8/1992 | Fulton | |
| 5,310,070 | A | | 5/1994 | Haas et al. | |
| 5,513,819 | A | | 5/1996 | Orange | |
| 5,657,872 | A | | 8/1997 | Leftwich et al. | |
| 6,027,017 | A | | 2/2000 | Kuhn et al. | |
| 6,382,447 | B1 | | 5/2002 | Loeschen | |
| 6,499,655 | B1 | | 12/2002 | Moen | |
| 6,896,174 | B2 | | 5/2005 | Gosis et al. | |

FOREIGN PATENT DOCUMENTS

| | | |
|---|---|---|
| FR | 2642404 | 7/1990 |
| GB | 537287 | 6/1941 |
| GB | 1004269 | 9/1965 |

* cited by examiner 132
24
124
128
106
136
126
130
122
134
118
118
126
19
19
134
134

SINGLE PIECE PACKAGING CONTAINER AND DEVICE FOR MAKING SAME

CROSS REFERENCE TO RELATED PATENT APPLICATIONS

The present application is a divisional patent application of U.S. patent application Ser. No. 10/644,130 filed on Aug. 20, 2003 now U.S. Pat. No. 7,140,533 for a "Single Piece Packaging Container and Device for Making Same."

BACKGROUND OF THE INVENTION

The present invention is directed to packaging containers and a device for making the containers. More particularly, the present invention pertains to configurations for a packing container having self-formed end closures, created from a single piece of material. The present invention also pertains to a device for forming the containers.

Packaging for lengthy items takes many forms. One construction includes a pair of corrugated, laminated paperboard top and bottom U-shaped channels configured for one to fit within the other. Most packages formed in this manner require separate end closures or caps, usually manufactured from cardboard or wood. These caps generally are stapled to adjacent package walls. Not only does this method necessitate close-fit manufacturing, but it is also very cumbersome at installation, and may cause content damage due to incompletely formed or off-positioned staples.

In another variety of packaging container, one of the top and bottom U-shaped channels has a notch cut into opposing side walls of the "U," so that the "U" portion may be folded over at a 90 degree angle. In such a configuration, channel ends are closed by the folded base portion and the side walls of the "U," which are folded over adjacent side walls. To seal such a package, tape or a like strip-type adhesive sealant must be extended over the flaps that then are folded over the adjacent side walls. Even though a seal may be formed, openings may remain at the juncture of the folded-over base portion and the cover portion, seriously weakening the package. This design is disclosed in U.S. Pat. No. 4,976,374.

Another existing packaging container, disclosed in Loeschen, U.S. Pat. No. 6,382,447, resolves the above-referenced problems by providing a packaging container in which the entirety of the end closure is formed from the packaging material itself. However, the container base unit, which forms end closures for the packaging container, features mitered corners. These mitered corners require complex die-cutting with mirrored tools, and mandatory strapping at specific positions to restrain the miter flaps. The patent to Loeschen, which is commonly assigned herewith, is incorporated herein by reference.

A new, single-piece packaging container cut without miters is disclosed in application Ser. No. 10/264,506, filed Oct. 4, 2002, assigned to the assignee of the present invention and incorporated herein by reference. The end closures of this packaging container are formed from the packaging material itself. The container allows for no gaps at its closure locations, because its end closures meet or overlap along the container's main body portion, providing a high degree of structural strength and package integrity. Manufacturing the container is extremely simple and cost-effective, requiring only two straight saw-cuts on each package end.

Occasionally, packaging containers must accommodate objects with varied local height elevations, or objects that require segregation during shipping or storage. Normally, shippers rely on foam fillers or container partitions to protect such irregularly shaped or fragile objects. Foam fillers may compress, leak, or shift, and container partitions may shift or break during shipping, rendering shippers' attempts to protect their products worthless. Accordingly, there exists a need for specialized configurations for a single-piece packaging container having self-formed end closures, providing better protection for fragile and/or irregularly shaped objects than undependable foam fillers or container partitions.

BRIEF SUMMARY OF THE INVENTION

Configurations for a packing container formed from a single, preformed, rigid unit of U-shaped cross-section having a main body portion with a bottom wall and opposing side walls, and having self-formed end closures are disclosed. The unit forms a plurality of end closures, at each end of the packaging container. Each end closure is formed from a plurality of closure panels extending from and adjacent to each end of the main body portion. The main body portion and the plurality of end closures are separated from one another by fold lines.

For purposes of the present disclosure, the package material, although defined as having a U-shaped cross-section is, in fact, formed from a material having a channel-like or squared U-shape having a flat or near-flat bottom wall. The corners may be formed having a radius of curvature (i.e., rounded) or they may be formed having relatively sharp angles. However, again, for purposes of the present disclosure, the container material is referred to as "U-shaped."

The main body portion and the plurality of closure panels all have straight-cut corners at their junctions with each other. Some closure panels are configured for folding generally perpendicular to each other and to the main body bottom wall, and others are configured for folding generally parallel to each other and to the main body bottom wall.

In one embodiment, the packaging container is configured to enclose an object with an elevated end (e.g., a support post with an attached asymmetrical flange). One of the end closure's closure panels has approximately the same height as the elevated end of the object to be packaged. Another embodiment is configured to enclose an object with an elevated mid-section (e.g., a crankshaft with integrated cam). Additional closure panels are included with this configuration, to accommodate the "bulge" made by the object's elevated mid-section.

In another embodiment, the packaging container is configured to enclose an object with random elevations. Two of the end closure's closure panels have approximately the same height as the highest elevation of the object to be packaged. A fourth embodiment is configured to enclose two or more dissimilar objects that should be prevented from touching or intermingling during shipping in separate compartments. Another embodiment is configured to combine elements of the four above-referenced configurations, allowing a user to ship objects with elevated ends, elevated mid-sections, or random elevations in separate compartments. A sixth embodiment is configured to enclose one or more objects with a set of two closure panels that are about equal in length to one another.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
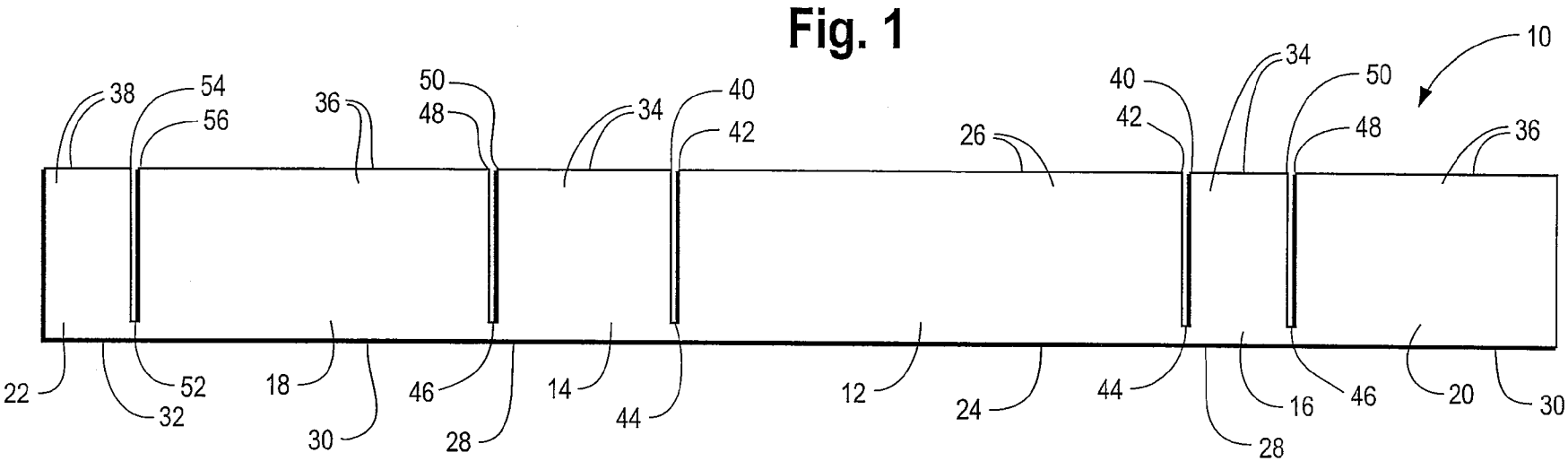
FIG. 1 is a side view of a configuration for a single-piece packaging container with straight-cut end closures constructed in accordance with the principles of the present invention, the container being shown with its first, second, and third closure panels laid open, prior to folding and securing.

While the present invention is susceptible of embodiment in various forms, there is shown in the drawings and will hereinafter be described presently preferred embodiments with the understanding that the present disclosures are to be considered exemplifications of the invention and are not intended to limit the invention to the specific embodiments illustrated.

It should be further understood that the title of this section of this specification, namely, "Detailed Description Of The Invention," relates to a requirement of the United States Patent Office, and does not imply, nor should be inferred to limit the subject matter disclosed herein.

Referring now to the figures and in particular FIG. 1, there is shown a packaging container 10, configured to enclose an object with an elevated end (e.g., a support post with an attached asymmetrical flange) in one of the embodiments of the present invention. The packaging container is formed in a U-shaped cross-section. Preferably, the packaging container is formed from laminated paperboard material. The packaging container includes a main body portion 12, first closure panels 14, 16, second closure panels 18, 20, and a third closure panel 22. The straight-cut first, second, and third closure panels are formed from an extension of the main body portion 12. The main body portion has a bottom wall 24 and side walls 26. The first, second, and third closure panels 14, 16, 18, 20, and 22, also have bottom walls 28, 30, and 32, and side walls 34, 36, and 38.

The first closure panels 14, 16 are formed adjacent to and at either end of the main body portion 12. The side walls 34 of the first closure panels 14, 16 have first straight-cut corners 40. The main body side walls 26 also have straight-cut corners 42, immediately adjacent to the first panels' straight-cut corners 40. First fold lines or creases 44 can be formed between the main body bottom wall 24 and the firs closure panels' bottom walls 28 at the junctures of the straight-cut corners 42, 44 to facilitate folding.

The second closure panels 18, 20 are adjacent to the first closure panels 14, 16. The second closure panels 18, 20 are separated from the first panels 14, 16 by second fold or crease lines 46 formed between the first closure panels' bottom walls 28 and the second closure panels' bottom walls 30, parallel to the first fold lines 44. The side walls 36 of the second closure panels 18, 20 include first straight-cut corners 48 at the junctures with the first closure panels 14, 16.

The side walls 34 of the first closure panels 14, 16 include second straight-cut corners 50 adjacent to the second closure panels 18, 20.

The third closure panel 22 is adjacent to one of the second closure panels 18. The third closure panel 22 is separated from the second panel 18 by third fold or crease lines 52 formed between the second closure panel's bottom walls 30 and the third closure panel's bottom walls 32, parallel to the first and second fold lines 44, 46. The side walls 38 of the third closure panel 22 include straight-cut corners 54 at the junctures with the second closure panel 18. The side walls 36 of the second closure panel 18 include second straight-cut corners 56 adjacent to the third closure panel 22.

The height $h_{26}$ of the main body side walls 26 is about equal to the heights $h_{34}$, $h_{36}$, and $h_{38}$ of the first closure panels side walls 34, second closure panels side walls 36, and third closure panels side walls 38. The length $l_{14}$ of one of the first closure panels 14 is approximately equal to the height $h_{52}$ of the object 52 (see FIG. 2) with an elevated end enclosed within the package 10. The length $l_{16}$ of the other first closure panels 16 is approximately equal to the heights $h_{20}$, $h_{34}$, $h_{36}$, and $h_{38}$ of the main body, first closure panels, second closure panels, and third closure panel side walls 20, 34, 36, and 38.

Figure 2:
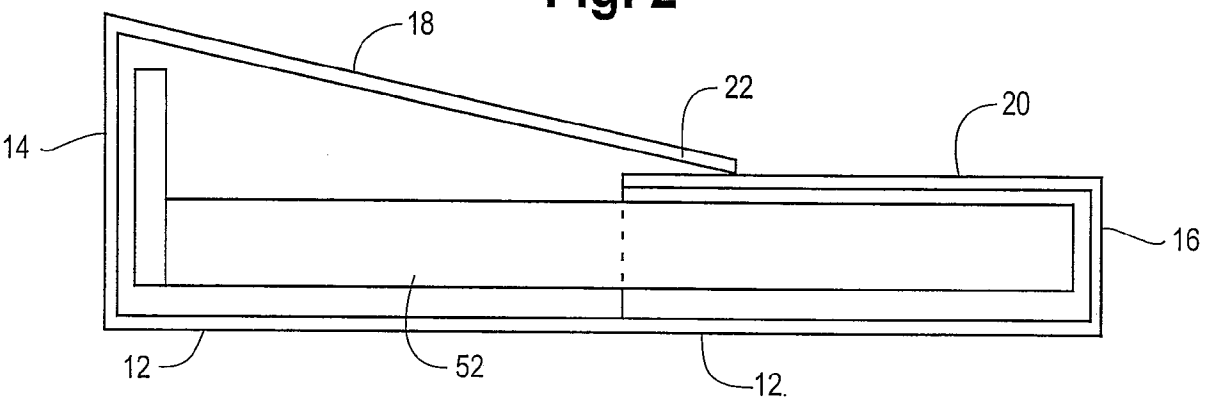
FIG. 2 is a side view of the configuration of FIG. 1, showing the packaging container enclosing an object with an elevated end.

Referring to FIG. 2, assembling the package 10 is straightforward and readily carried out. The package 10 is placed on a surface, with the main body 12, and the first, second, and third closure panels 14, 16, 18, 20, and 22, laid out flat. The article to be packaged 58 is placed in the main body portion 12. The first panels 14, 16 are then folded upwardly, so that the first panels 14, 16 are perpendicular to the bottom wall 24 of the main body portion 12. As the first panels 14, 16 are folded, their side walls 34 can be inserted between the main body side walls 26. The second panels 18, 20 are then folded over, perpendicular to the first panels 14, 16, so that the bottom walls 30 of the second panels 18, 20 lie substantially parallel to the bottom wall 24 of the main body portion 12. As the second panels 18, 20 are folded, their side walls 36 can be inserted between the side walls 34 of the first panels 14, 16. Finally, the third panel 22 is folded, generally perpendicular to the first closure panels 14, 16, generally parallel to the main body bottom wall 24, and overlapping one of the second closure panels 20. As the third panel 22 is folded, its side walls 38 can be inserted between the side walls 26 of the main body portion 12. FIG. 2 shows the package 10 fully assembled and enclosing an object 58 with an elevated end. One of the corners 50 of one of the first closure panels 14 and one of the corners 48 of one of the second closure panels 18 may be trimmed to facilitate package forming.

Figure 3:
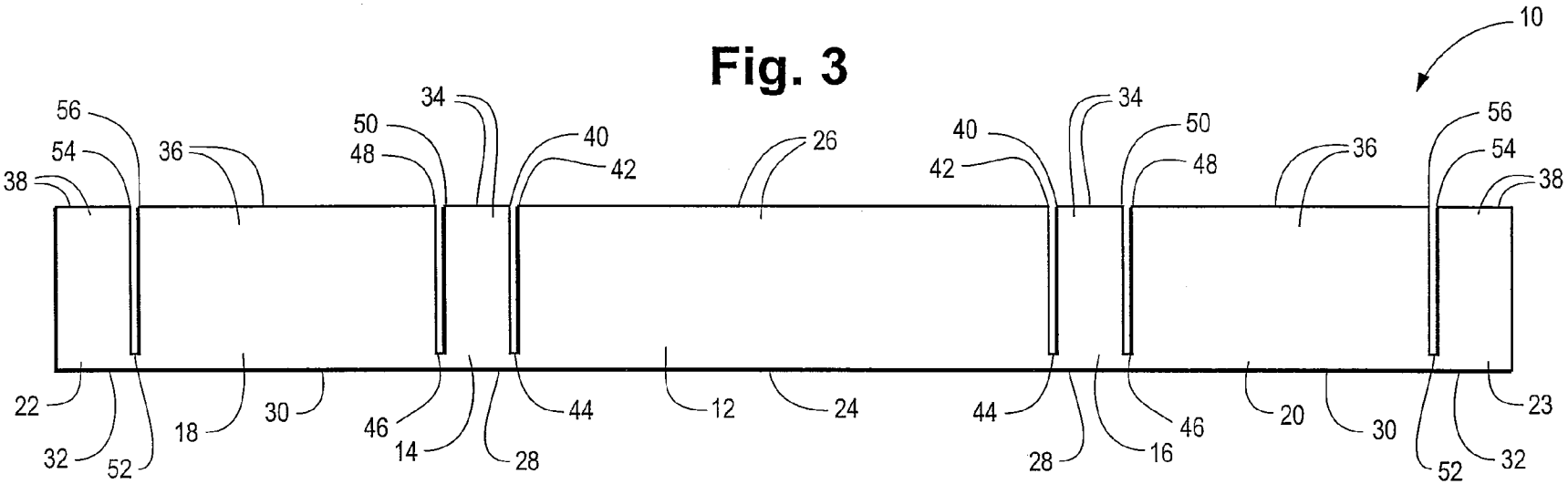
FIG. 3 is a side view of another configuration for single piece packaging container with straight-cut end closures constructed in accordance with the principles of the present invention, the container being shown with its first, second, and third closure panels laid open, prior to folding and securing.
Figure 4:
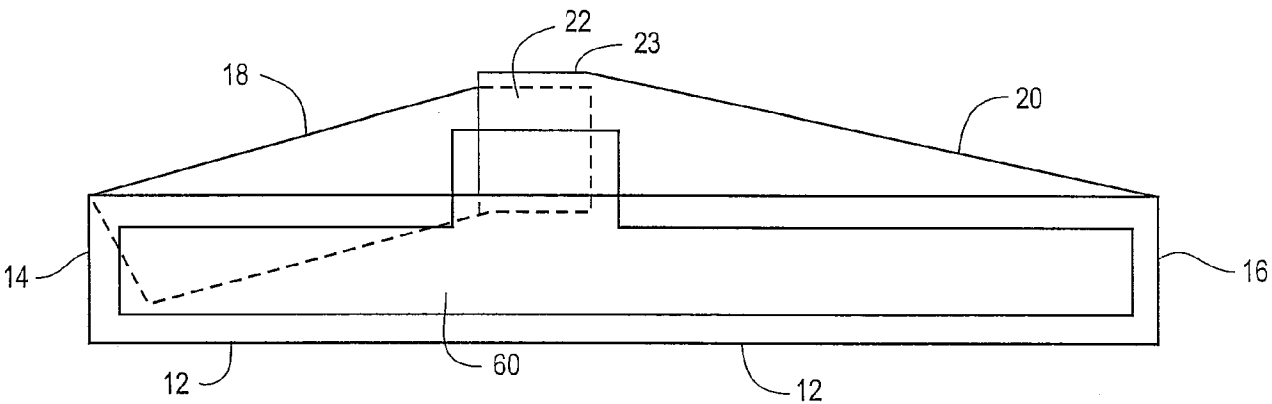
FIG. 4 is a side view of the configuration of FIG. 3, showing the packaging container enclosing an object with an elevated mid-section.

Another embodiment of the present invention is displayed in FIGS. 3 and 4, which show a packaging container configuration designed to enclose an object with an elevated mid-section 60 (e.g., a crankshaft with an integrated cam). Similar to the configuration shown in FIGS. 1 and 2, the packaging container 10 includes a main body portion 12, first closure panels 14, 16, and second closure panels 18, 20, but the present embodiment incorporates two third closure panels 22, 23 instead of one. The lengths $l_{14}$, $l_{16}$ of the first closure panels 14, 16 are approximately equal to the heights $h_{26}$, $h_{34}$, $h_{36}$, and $h_{38}$ of the main body, first closure panels, second closure panels, and third closure panel side walls 26, 34, 36, and 38.

Referring to FIG. 4, to assemble the package, the main body 12, and the first, second, and third closure panels 14, 16, 18, 20, 22, and 23 are laid out flat on a surface. The article to be packaged 60 is placed in the main body portion 12. The first panels 14, 16 are then folded upwardly, so that the first panels 14, 16 are perpendicular to the bottom wall 24 of the main body portion 12. As the first panels 14, 16 are folded, their side walls 34 can be inserted between the main body side walls 26. The second panels 18, 20 are then folded over at roughly a 45-degree angle to the first panels 14, 16, so that the bottom walls 30 of the second panels 18, 20 lie at substantially at 45-degree angle to the bottom wall 24 of the main body portion 12. As the second panels 18, 20 are folded, their side walls 36 can be inserted between the side walls 34 of the first panels 14, 16. Finally, the third panels 22, 23 are folded, generally at a 45-degree angle to the second closure panels 14, 16, parallel to the main body bottom wall 24, and overlapping one another to accommodate the mid-section bulge of the object 60. As the third panels 22, 23 are folded, their side walls 38 can be inserted between the side walls 26 of the main body portion 12. The second closure panels 18, 20 may vary in length $l_{18}$, $l_{20}$, but together should always be equal to the length $l_{12}$ of the main body portion 12. FIG. 4 shows the package 10 fully assembled and enclosing an object 60 with an elevated mid-section.

Figure 5:
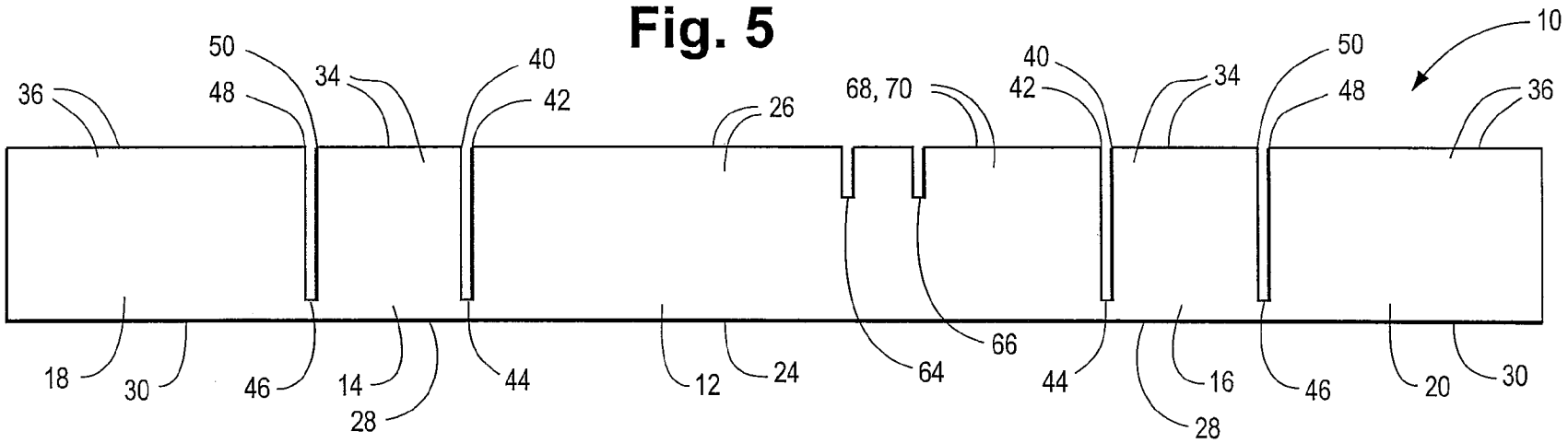
FIG. 5 is a side view of another configuration of a single piece packaging container with straight-cut end closures constructed in accordance with the principles of the present invention, the container being shown with its first and second closure panels laid open, prior to folding and securing.
Figure 6:
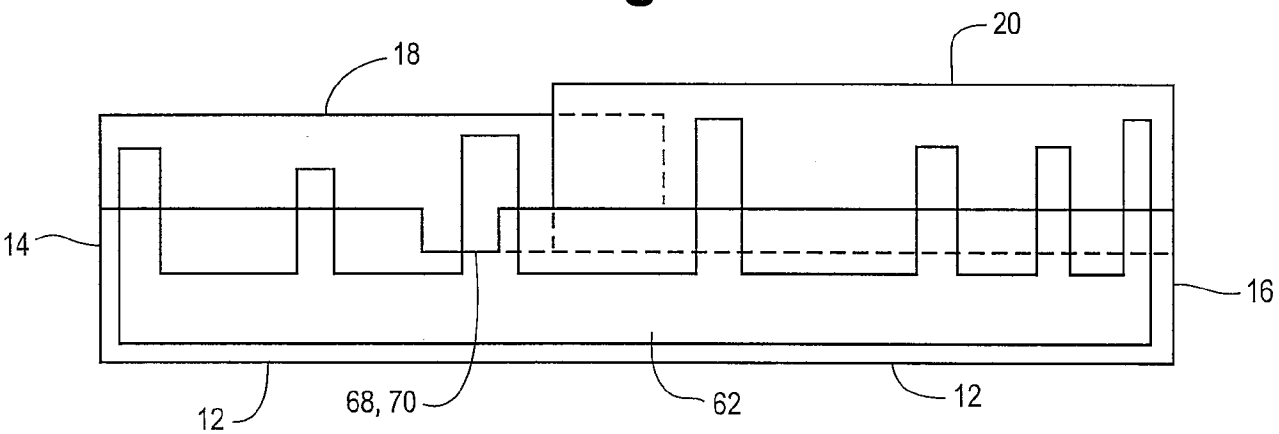
FIG. 6 is a side view of the configuration of FIG. 5, showing the packaging container enclosing an object with random elevations.
Figure 7:
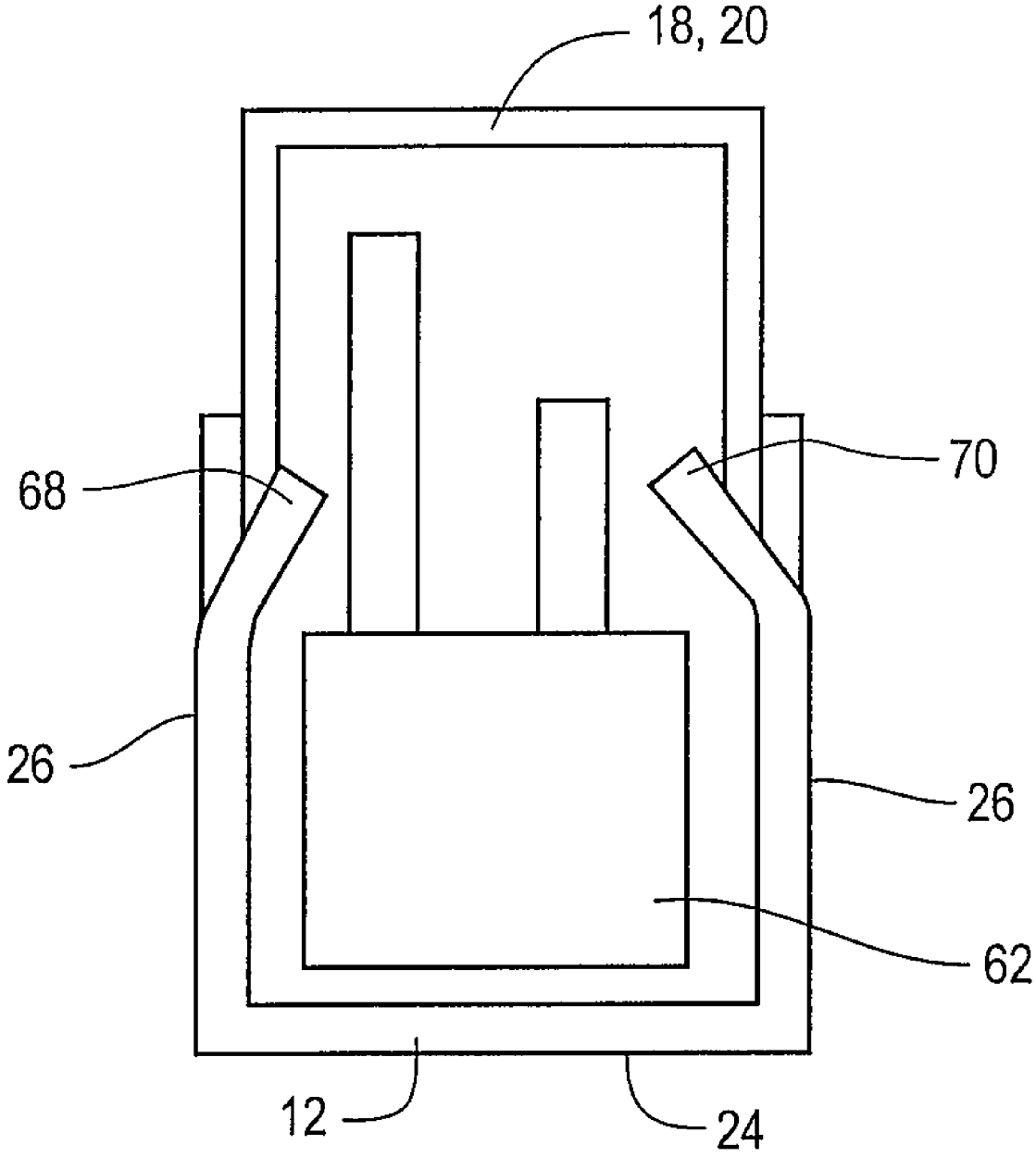
FIG. 7 is a front view of the configuration of FIG. 5 along line 7-7, showing the packaging container enclosing an object with random elevations.

A third embodiment of the present invention is illustrated in FIGS. 5-7, which show a packaging container configuration designed to enclose an object with random elevations 62. Similar to the configurations shown in FIGS. 1-4, the packaging container 10 includes a main body portion 12, first closure panels 14, 16, and second closure panels 18, 20, but no third closure panels. The lengths $l_{14}$, $l_{16}$ of the first closure panels 14, 16 are approximately equal to the highest height of the object 62 with random elevations enclosed within the package 10.

Two additional short slits 64, 66 are cut into the side walls 26 of the main body portion 12, creating small support wedges 68, 70. The slits 64, 66 are positioned close to the center of the main body portion side walls 26, and are spaced approximately two inches apart. The height $h_{64}$, $h_{66}$ of the slits is approximately half the height $h_{26}$ of the main body portion 12 side walls 26. Both support wedges 68, 70 are slightly deformed inward, allowing the second closure panels 18, 20 to rest upon them (see FIGS. 6 and 7) when closed.

FIGS. 6 and 7 show the packaging container 10 as assembled. The main body 12, and the first and second closure panels 14, 16, 18, and 20 are laid out flat on a surface. The article to be packaged 62 is placed in the main body portion 12. The first panels 14, 16 are then folded upwardly, so that the first panels 14, 16 are perpendicular to the bottom wall 24 of the main body portion 12. As the first panels 14, 16 are folded, their side walls 34 can be inserted between the main body side walls 26. The second panels 18, 20 are then folded over, perpendicular to the first panels 14, 16 so that the bottom walls 30 of the second panels 18, 20 lie substantially parallel to the bottom wall 24 of the main body portion 12. As the second panels 18, 20 are folded, their side walls 36 can be inserted between the side walls 34 of the first panels 14, 16. The side walls 36 of the second closure panels 18, 20 rest on the support wedges 68, 70 formed in the main body side walls 26. FIG. 6 shows the package 10 fully assembled and enclosing an object 62 with random elevations. FIG. 7 shows a front cut-away view of the package 10 fully assembled and enclosing an object 62 with random elevations.

Figure 8:
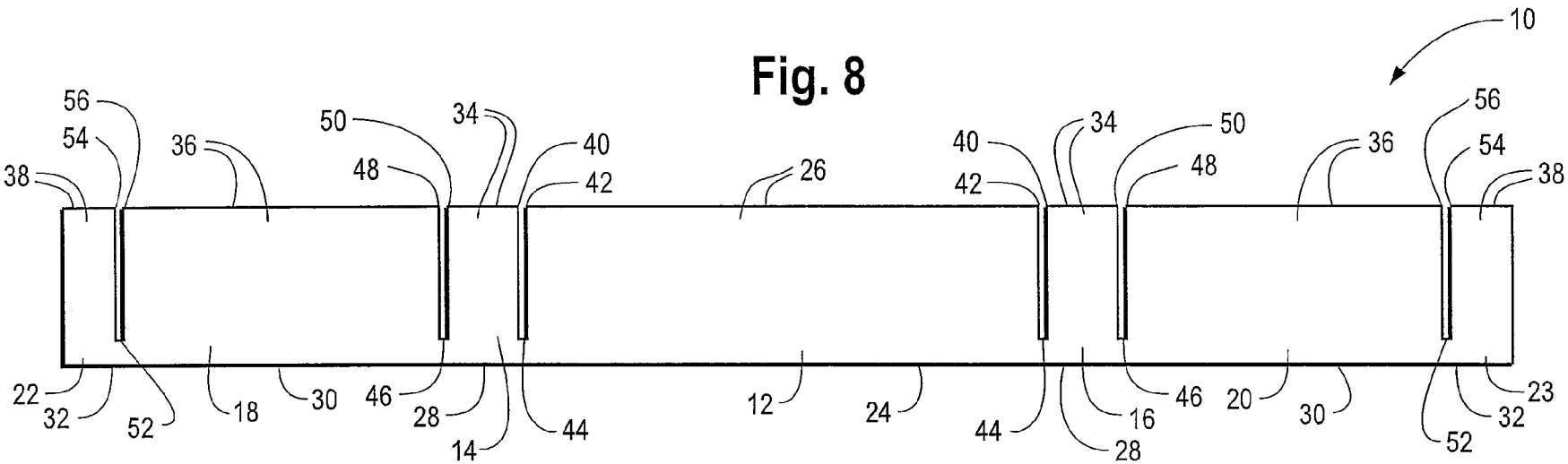
FIG. 8 is a side view of another configuration of a single piece packaging container with straight-cut end closures constructed in accordance with the principles of the present invention, the container being shown with its first, second, and third closure panels laid open, prior to folding and securing.
Figure 9:
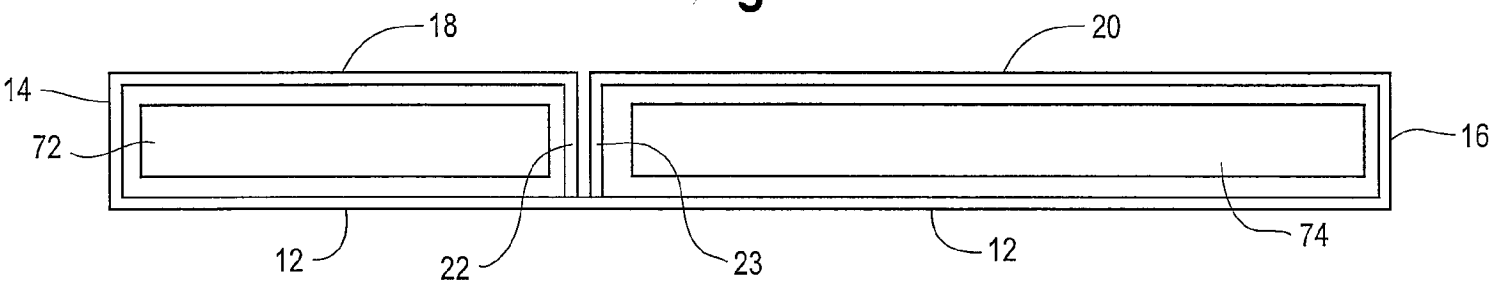
FIG. 9 is a side view of the configuration of FIG. 8, showing the packaging container enclosing two objects in two separate compartments.

A fourth embodiment of the present invention is demonstrated in FIGS. 8 and 9, which show a packaging container configuration designed to enclose two related but dissimilar objects or groups of objects 72, 74, which should be prevented from touching or intermixing during shipping. Similar to the configurations shown in FIGS. 3 and 4, the packaging container 10 includes a main body portion 12, first closure panels 14, 16, second closure panels 18, 20, and third closure panels 22, 23. The lengths $l_{14}$, $l_{16}$ of the first closure panels 14, 16 and $l_{22}$, $l_{23}$ of the third closure panels 22, 23 are approximately equal to the heights $h_{20}$, $h_{34}$, $h_{36}$, and $h_{38}$ of the main body, first closure panels, second closure panels, and third closure panel side walls 20, 34, 36, and 38.

Referring to FIG. 9, to assemble the package, the main body 12, and the first, second, and third closure panels 14, 16, 18, 20, 22, and 23 are laid out flat on a surface. The articles to be packaged 72, 74 are placed on either end of the main body portion 12. The first panels 14, 16 are then folded upwardly, so that the first panels 14, 16 are perpendicular to the bottom wall 24 of the main body portion 12. As the first panels 14, 16 are folded, their side walls 34 can be inserted between the main body side walls 26. The second panels 18, 20 are then folded over, perpendicular to the first panels 14, 16, so that the bottom walls 30 of the second panels 18, 20 lie substantially parallel to the bottom wall 24 of the main body portion 12. As the second panels 18, 20 are folded, their side walls 26 can be inserted between the side walls 34 of the first panels 14, 16. Finally the third panels 22, 23 are folded, generally perpendicular to the second closure panels 18, 20 and the main body bottom wall 24, and generally parallel to the first closure panels 14, 16. As the third closure panels 22, 23 are folded, their side walls 38 can be inserted between the side walls 36 of the second closure panels 18, 20. When folded, the third closure panels 22, 23 form a double-thick divider, separating the packaged objects 72, 74. The second closure panels 18, 20 may vary in length $l_{18}$, $l_{20}$, but together should always be equal to the length $l_{12}$ of the main body portion 12. FIG. 9 shows the package 10 fully assembled and enclosing objects 72, 74 that should be prohibited from touching or intermixing during shipping.

The present configuration additionally may be used as a packaging container with a built-in spacer. Frequently, objects are somewhat shorter than the length of available shipping containers. For example, it would be economical to ship an object four feet to five-and-a-half feet in length in a six-foot-long standard box. Usually, such an object would be randomly placed in a too-large box and covered with foam fillers or other, similar protective materials. However, fillers may compress, leak, or shift, leaving shipped objects without protection. Conversely, using the packaging container 10 described in FIGS. 8 and 9, the short object could be placed against one end of the container 10, and then custom enclosed into a segregated side, with a double-thick divider separating it from the other, fully-formed, hollow chamber. The present configuration allows shippers to customize packaging containers by creating a segregated, perfectly-sized compartment within a standard-sized box.

Figure 10:
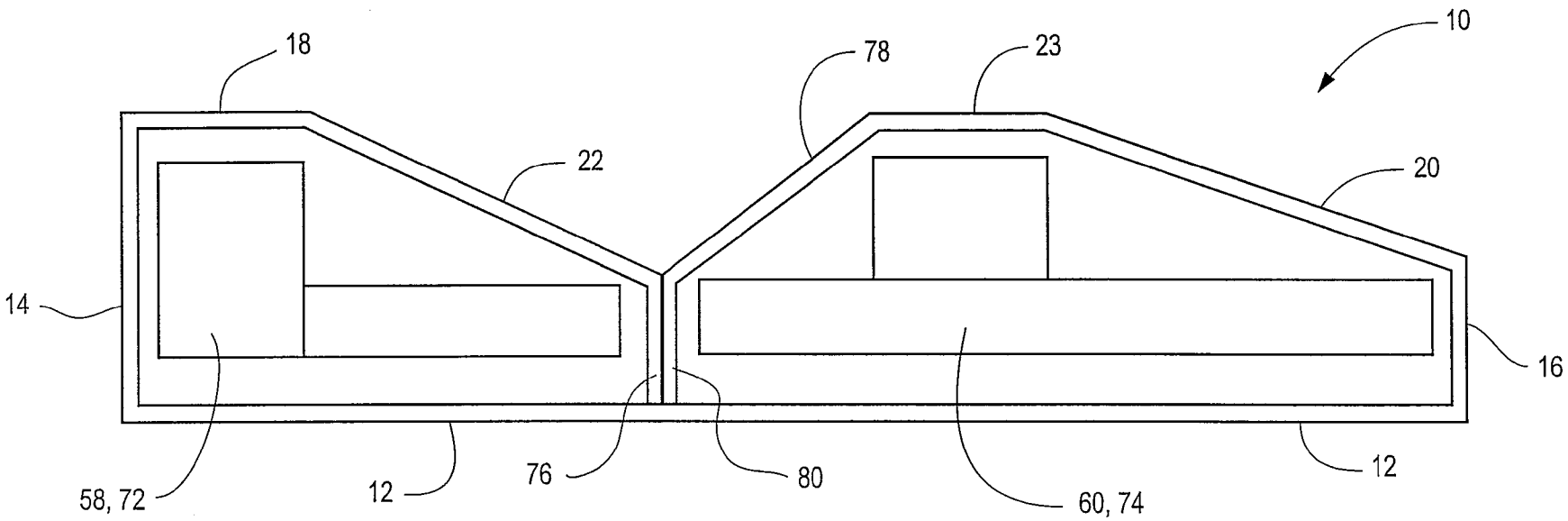
FIG. 10 is a side view of another configuration of a single piece packaging container with straight-cut end closures constructed in accordance with the principles of the present invention, the container shown enclosing two objects, one with an elevated end, and the other with an elevated mid-section, in two separate compartments.

A fifth embodiment of the present invention is demonstrated in FIG. 10, which shows a packaging container configuration designed to combine all four of the above described configurations. As described in detail above, the packaging container 10 exhibited in FIG. 10 can accommodate and object with an elevated end 58, an object with an elevated mid-section 60, an object with random elevations 62 (not shown), and objects that must be segregated during shipping 72, 74. To accomplish the composition of FIG. 10, the side of the main body portion 12 containing the object with an elevated end requires four closure panels (14, 18, 22, 76), and the side of the main body portion 12 containing the object with an elevated mid-section requires five closure panels (16, 20, 23, 78, 80). All of the closure panels are folded and inserted according to the above descriptions, resulting in completely object coverage and a double thick divider. If an object with random elevations 62 was packaged as part of a combination container, four closure panels would be required for its end of the container.

Figure 11:
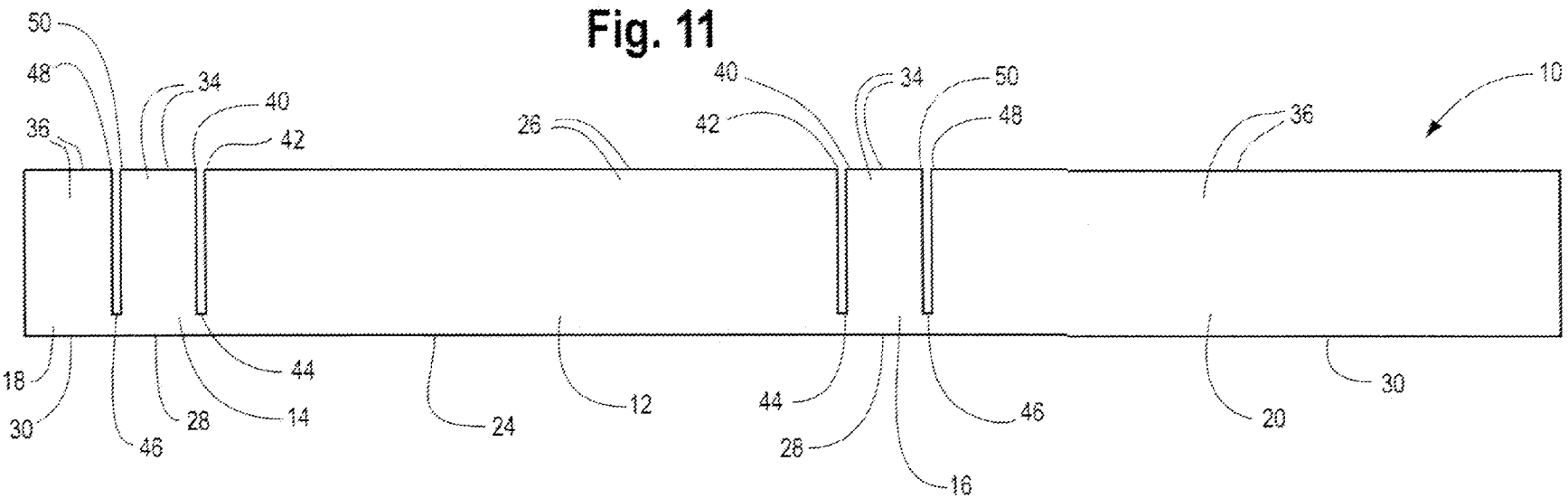
FIG. 11 is a side view of another configuration of a single piece packaging container with straight-cut end closures constructed in accordance with the principles of the present invention, the container being shown with its first and second closure panels laid open, prior to folding and securing.
Figure 12:
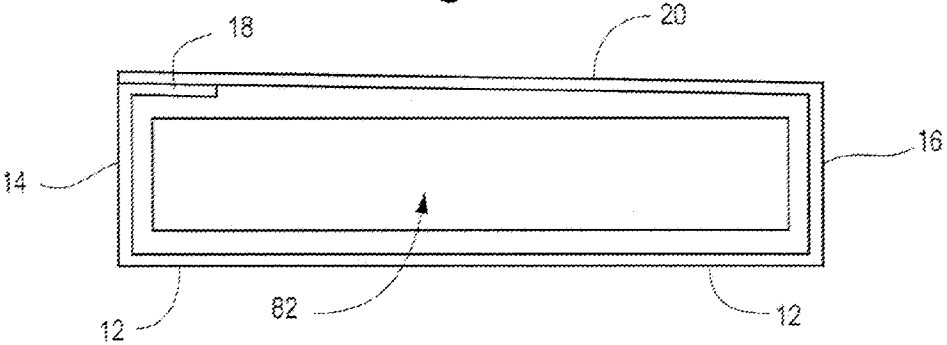
FIG. 12 is a side view of the configuration of FIG. 11, showing the packaging container enclosing an object.

A sixth embodiment is presented in FIGS. 11 and 12, which show a packaging container configuration designed to enclose one or more objects 82. Similar to the configuration shown in FIGS. 5 and 6, the packaging container 10 includes a main body portion 12, first closure panels 14, 16, and second closure panels 18, 20, but no third closure panels. The lengths $l_{14}$, $l_{16}$ of the first closure panels 14, 16 are approximately equal to the heights $h_{26}$, $h_{34}$, and $h_{36}$ of the main body, first closure panels, and second closure panels side walls 26, 34, and 36. In that this is a "seamless" container, the second closure panel 20 has a length $l_{20}$ that is about equal to the length $l_{12}$ of the main body portion 12.

FIG. 12 shows the packaging container 10 as assembled. The main body 12, and the first and second closure panels 14, 16, 18, and 20 are laid out flat on a surface. The article to be packaged 82 is placed in the main body portion 12. The first panels 14, 16 are then folded upwardly, so that the first panels 14, 16 are perpendicular to the bottom wall 24 of the main body portion 12. As the first panels 14, 16 are folded, their side walls 34 can be inserted between the main body side walls 26. The second panels 18, 20 are then folded over, perpendicular to the first panels 14, 16 so that the bottom walls 30 of the second panels 18, 20 lie substantially parallel to the bottom wall 24 of the main body portion 12. As the second panels 18, 20 are folded, their side walls 36 can be inserted between the side walls 34 of the first panels 14, 16. In that the length $l_{20}$ is about equal to the length $l_{12}$ of the main body portion 12, the container appears to be "seamless"; that is, the container appears to be without a mid container seam across the top (which is panel 20) or the main body portion 12.

Figure 13:
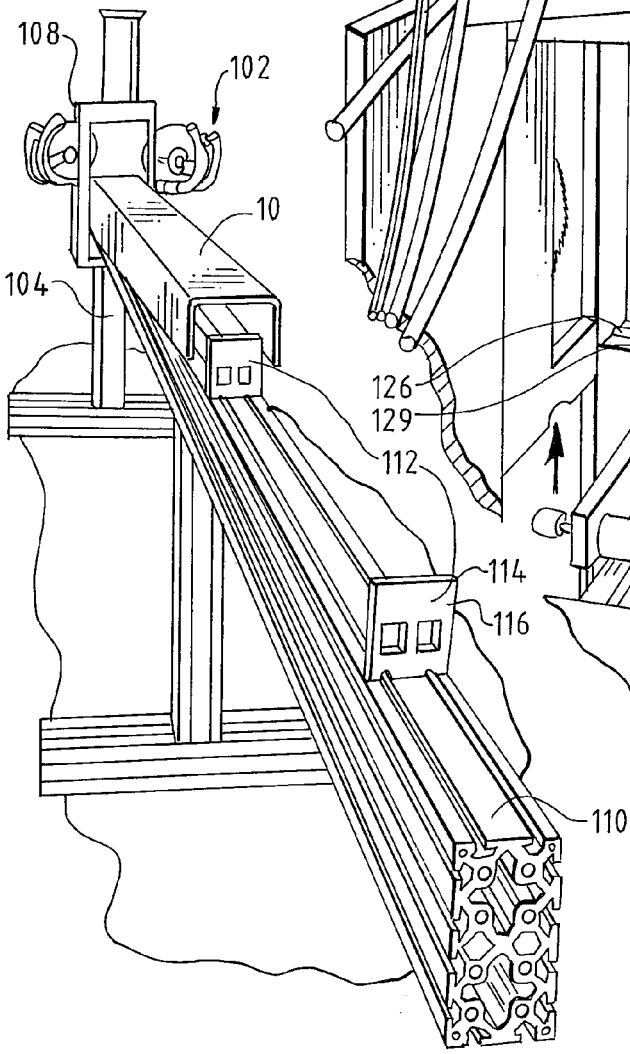
FIG. 13 is a perspective view of one device for forming the cuts in the packaging container material.

Referring now to FIG. 13, there is shown one cutter device 102 for forming or making the side wall cuts in the container 10 material. The cutter 102 includes a frame 104, a container support 106 and a carriage 108 that moves in a reciprocating manner in the direction of the cut. As illustrated, the container support 106 includes beam 110 on which are mounted stand-offs 112 for receiving the container 10. The container 10 rests on the stand-offs 112 to define a base surface 114 and side surfaces 116 for supporting the container 10 as it is cut.

The carriage 108 is configured to move down and up, toward and away from the container 10 as it rests on the support 106. The carriage 108 is configured to support a pair of rotary cutters 118, for example, circular saws, one each mounted a carriage side wall 120. In this manner, as the carriage 108 moves up and down (as indicated by the arrow at 122), the cutters 118 move up and down for cutting through the side walls of the container 10.

Figure 16:
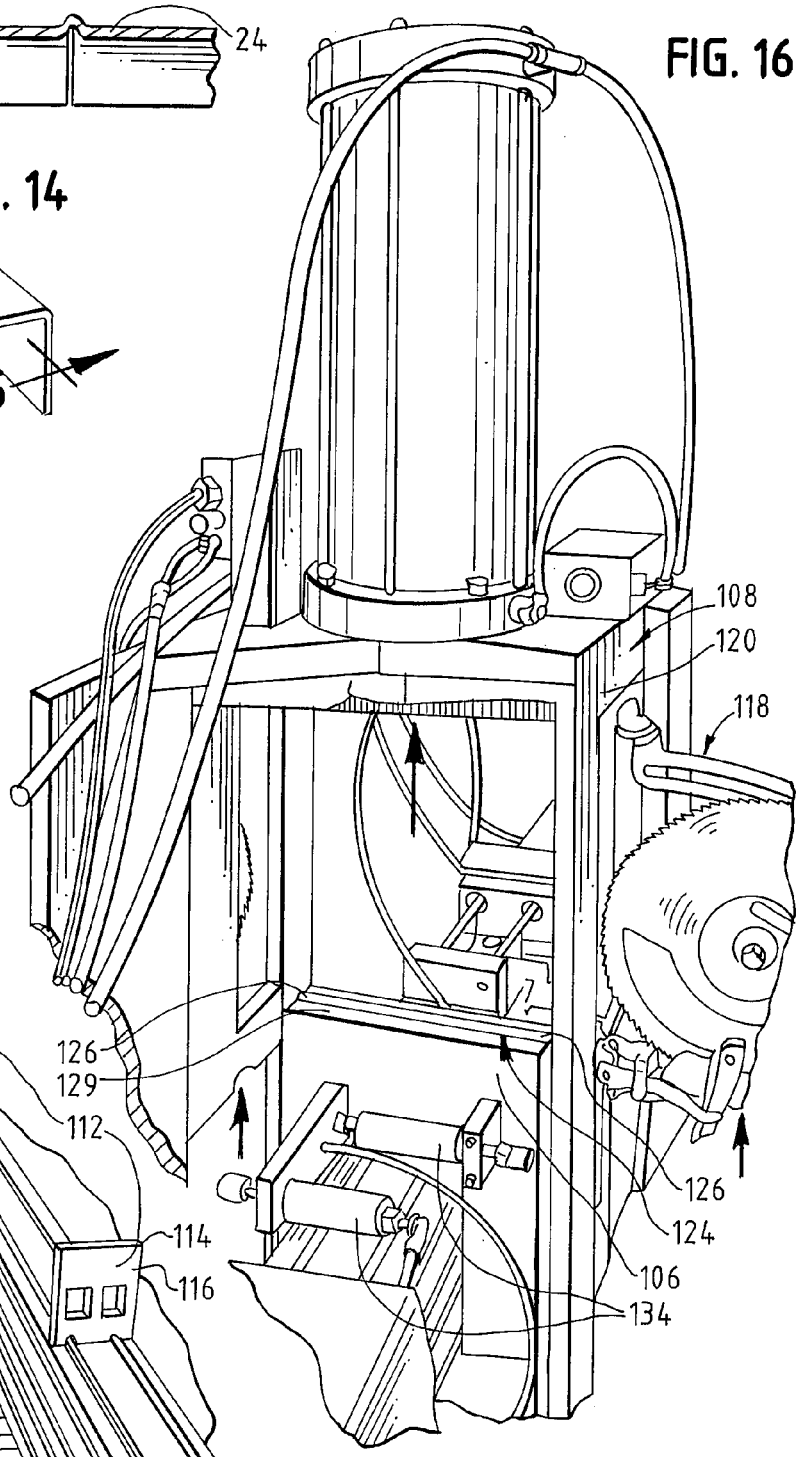
FIG. 16 is a perspective view of the cutter carriage shown with the carriage in the up or loading position.
Figures 17, 18, 19, 20:
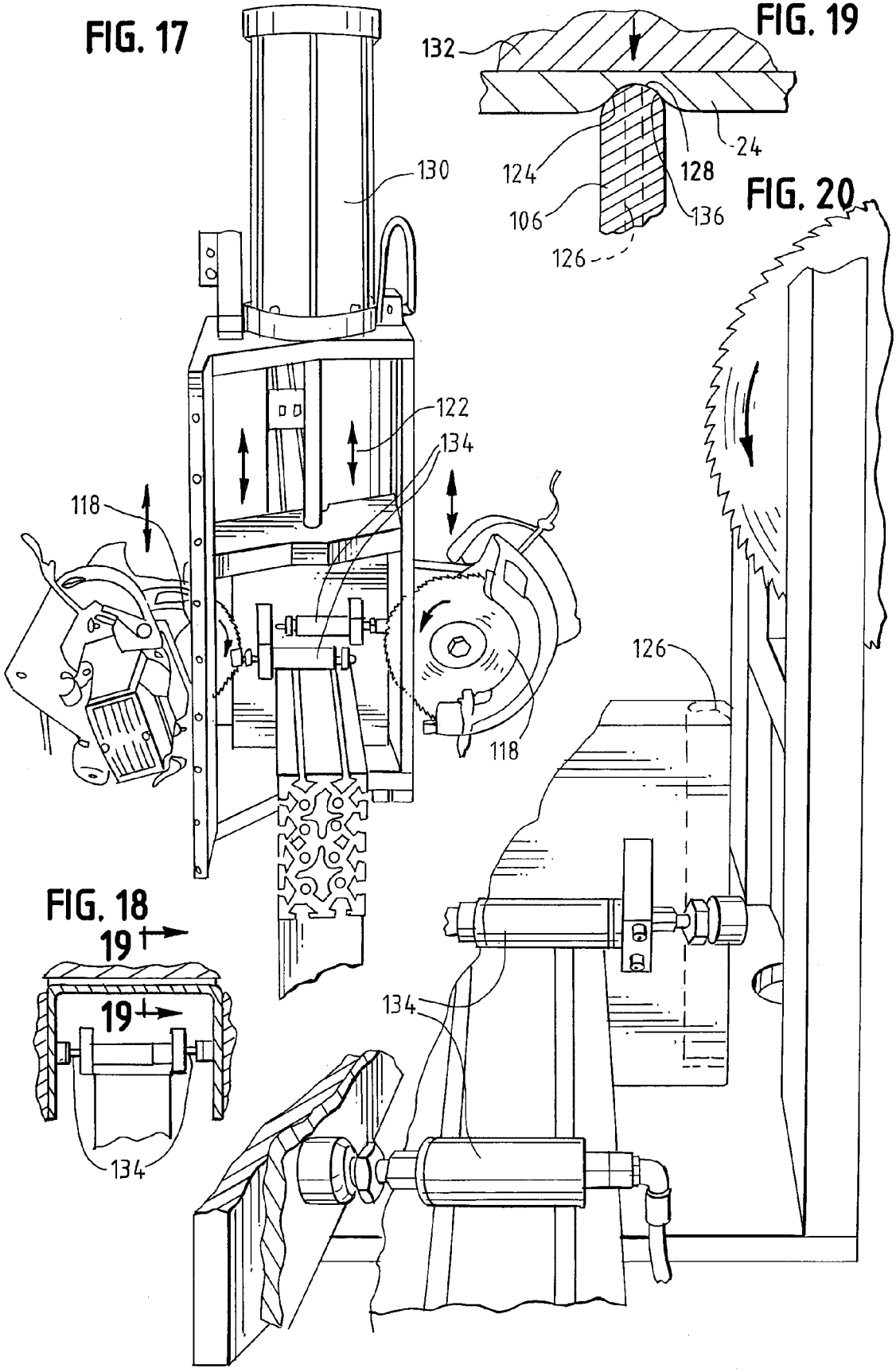
FIG. 17 is a side view of the cutter carriage of FIG. 16 shown with the carriage moving into the down or cutting position.
FIG. 18 is a partial side view of the cutter shown with a container loaded therein and with the holding pins securing the container within the cutter.
FIG. 19 is a cross-sectional view taken along line 19-19 of FIG. 18.
FIG. 20 is a partial side view of the carriage.

As best seen in FIGS. 16 and 20, a cutting anvil 124 is positioned on the support 106 at the location at which the cutters 118 move into the container 10. The anvil 124 includes channels 126 formed in the side walls to permit movement of the cutters 118 through the container side walls without contacting the anvil 124 side walls. In addition, the anvil 124 can include a raised portion or ridge 128 that extends transversely across the top wall 129 of the anvil 124 between the side wall channels 126.

In a present embodiment, the carriage 108 is moved up and down by action of a drive 130, such as the exemplary pneumatic cylinder. The pneumatic cylinder 130 is mounted to an upper carriage plate 132 to which the carriage side plates or walls 120 (mounting the cutters 118 to the carriage 108) are mounted. In this manner, reciprocating movement of the cylinder 130 moves the carriage 108 which moves the cutters 118 into and out of contact with the container 10. Other drives will be recognized by those skilled in the art and are within the scope and spirit of the present invention.

The cutters 118 are fixedly mounted to the carriage 108 to permit readily moving the carriage 108 up and down for cutting the container side walls. To facilitate holding or maintaining the container 10 in place as the carriage 108 moves downward and the cutters 118 move into contact with the container side walls, a pair of holding pins 134 can be mounted to the support 106. The holding pins 134 move outwardly to hold the container 10 side walls against the carriage side surfaces 116 as the cutters 118 make contact with the container 10. In a present embodiment, the pins 134 are pneumatically actuated.

Figure 15:
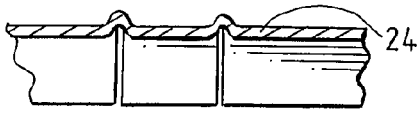
FIG. 15 is a cross-sectional view taken along line 15-15 of FIG. 14, illustrating a pair of embossings formed in the container material for enhanced container formation.
Figure 14:
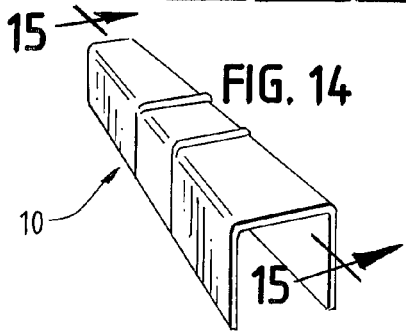
FIG. 14 is a perspective view of one exemplary container having cuts formed therein.

To further provide a "clean" container 10 appearance, the cutting device 102 is configured to emboss the container top or bottom wall 24 at fold or crease lines between the side wall cuts. As seen in FIGS. 15 and 19, the upper carriage plate 132 includes a transverse groove 136 formed therein that corresponds to the top wall ridge 128. In this manner as the carriage 108 moves down to move the cutters 118 into contact with the container 10 side walls, the upper plate 132 "presses" the container top (or bottom) wall 24 between the upper carriage plate 132 and the support top wall 129, sandwiching the container wall 24 between the ridge 128 and the groove 136, thus "embossing" a groove into the wall 24.

Figure 21:
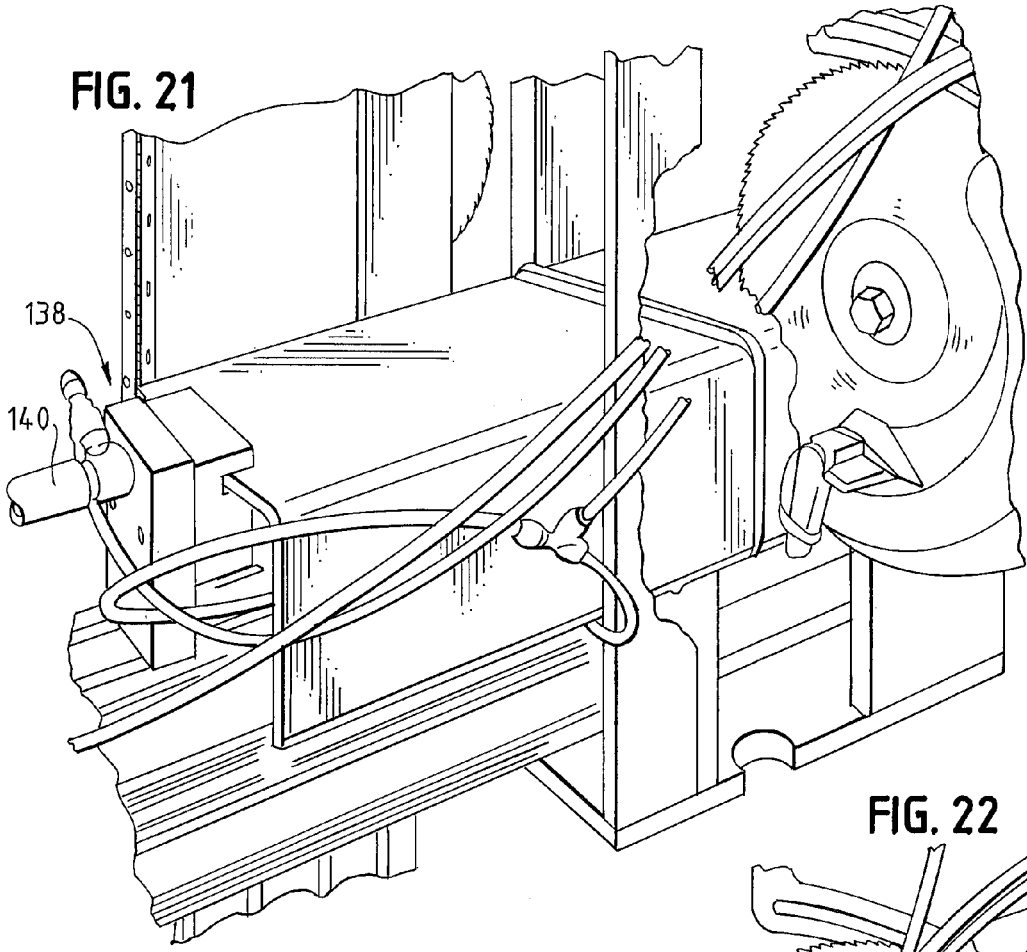
FIG. 21 is a perspective view of the cutter showing the indexing assembly in the retracted position.
Figure 22:
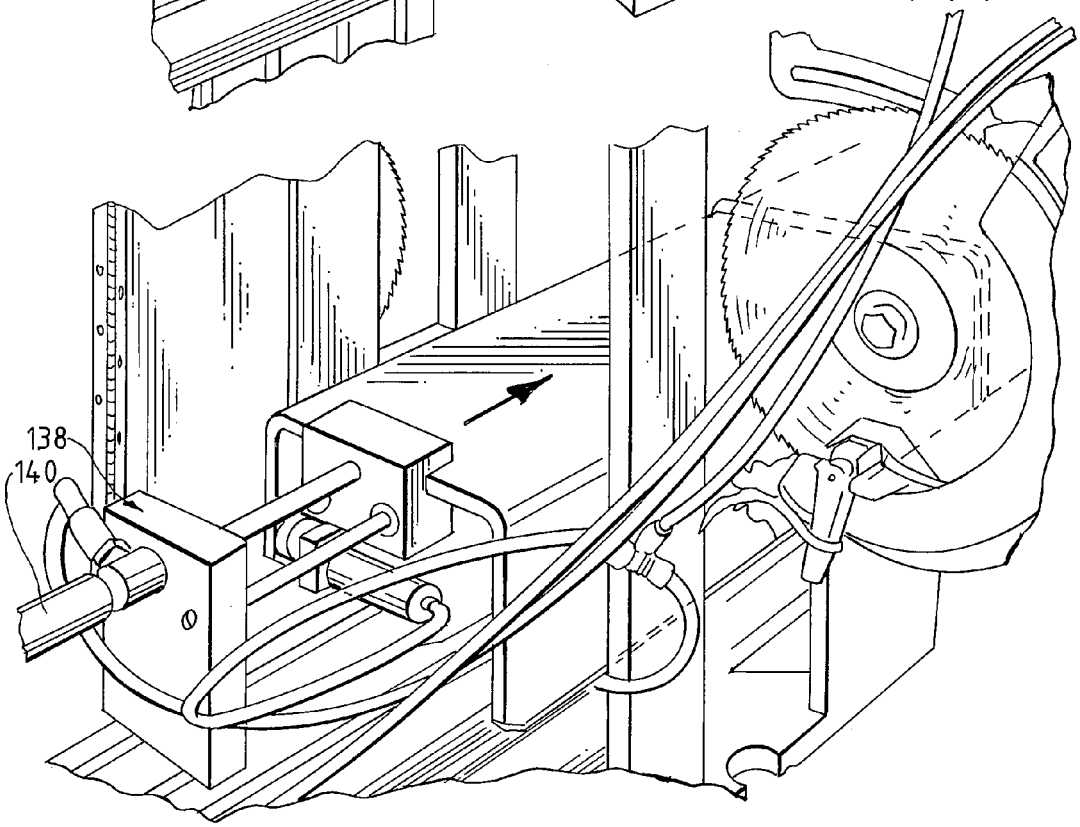
FIG. 22 is a perspective view of the cutter similar to FIG. 21 but showing the indexing assembly in the extended position.

To provide the appropriate spacing between cuts (e.g., to form appropriate sized panels 12, 14, 16), the cutter device 102 can include an indexing assembly 138. The indexing assembly 138 includes a drive 140, such as the exemplary pneumatic cylinder, to move the container 10 a desired distance once a first cut is made to position the container 10 for a second cut. To effect movement, the cylinder 140 cycles between a retracted position (FIG. 21) and an extended position (FIG. 22). The extension length or distance of the cylinder 140 can be set to correspond to the desired distance between cuts.

Figure 23:
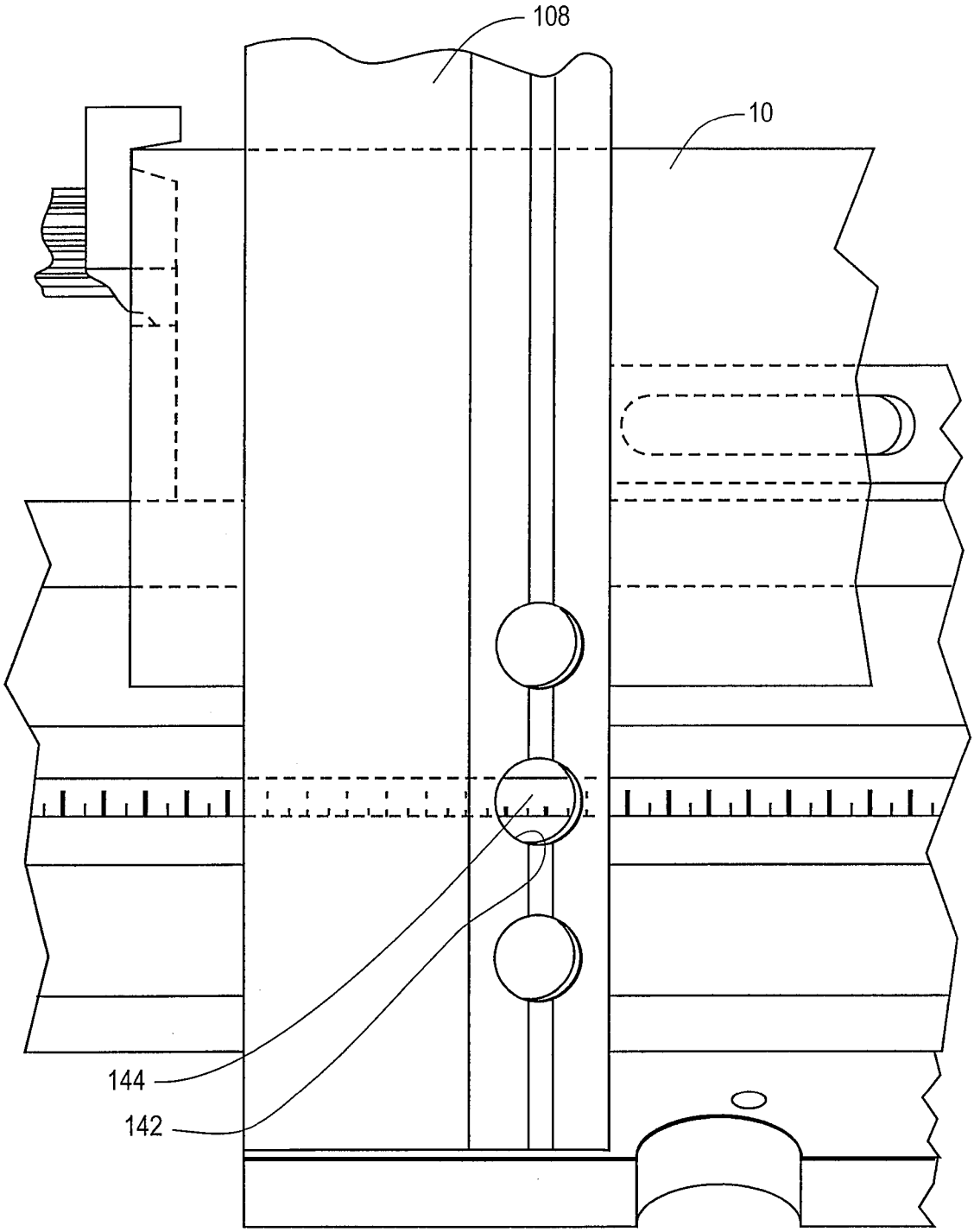
FIG. 23 is a front view of the cutter showing the scale windows through a lower portion of the carriage and the scale visible therethrough.

As seen in FIG. 23, the carriage 108 can include openings or windows 142 in a side thereof that overlie a scale 144 that is applied to the support beam 110. In this manner, the distance along the length of the container 10 at which the cut or cuts are formed can be precisely set and controlled.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing, it will be observed that numerous modifications and variations can be effected without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A configuration for a single piece packaging container enclosing two or more dissimilar objects which should be prevented from touching or intermixing during shipping, comprising:

a preformed, rigid unit of generally U-shaped cross-section having a main body portion with a bottom wall and opposing side walls, the unit forming three end closures for the packaging container, formed from primary and secondary first closure panels, the first closure panels having side walls, the first closure panels extending from and adjacent to both ends of the main body portion wherein both first closure panels have side walls, and the side walls have a height approximately equal to the height of the main body portion side walls, primary and secondary second closure panels extending from and adjacent to both ends of the first closure panels, the second closure panels having side walls, wherein the combined lengths of the second closure panels are approximately equal to the length of the main body portion, and third closure panels extending from and adjacent to both ends of the second closure panels, the third closure panels having side walls, the main body portion and the first closure panels being separated from one another by first fold lines, the first closure panels and the second closure panels being separated from one another by second fold lines, the third closure panels and the second closure panels being separated from one another by third fold lines, the main body portion side walls having straight-cut corners at their junctures with the first closure panels and the first closure panels side walls having first straight-cut corners adjacent the main body portion, the first closure panels side walls having second straight-cut corners adjacent the second closure panels and the second closure panels side walls having first straight-cut corners adjacent the first closure panels, the second closure panels side walls having second straight-cut corners adjacent the third closure panels and the third closure panels having straight-cut corners adjacent the second closure panels, the first closure panels being configured for folding generally perpendicular to the main body bottom wall, the second closure panels being configured for insertion inside the main body portion side wall, folding generally perpendicular to the first closure panels and generally parallel to the main body bottom wall, and the third closure panels being configured for insertion inside the second closure panels side walls, folding generally perpendicular to the main body portion bottom wall and generally parallel to the first closure panels, creating two separate compartments with a double-fold divider.

* * * * *